United States Patent [19]

Geke et al.

[11] Patent Number: 4,678,605

[45] Date of Patent: Jul. 7, 1987

[54] CATIONIC SURFACTANTS BASED ON QUATERNARY AMMONIUM COMPOUNDS AND METHODS OF USING SAME

[75] Inventors: Juergen Geke, Dusseldorf; Horst Rutzen, Langenfeld, both of Fed. Rep. of Germany

[73] Assignee: Henkel Kommanditgesellschaft auf aktien, Duesseldorf, Fed. Rep. of Germany

[21] Appl. No.: 820,281

[22] Filed: Jan. 17, 1986

[30] Foreign Application Priority Data

Jan. 21, 1985 [DE] Fed. Rep. of Germany ..... 3501775

[51] Int. Cl.[4] ..... C11D 1/62

[52] U.S. Cl. ..... 252/547; 252/8.75; 252/8.8; 252/528

[58] Field of Search ..... 252/528, 547, 8.75, 252/8.8; 260/501.17

[56] References Cited

U.S. PATENT DOCUMENTS

| | | | |
|---|---|---|---|
| 3,636,114 | 1/1972 | Tobler et al. | 252/8.75 |
| 3,896,034 | 7/1975 | Eckert et al. | 252/547 |
| 4,284,434 | 8/1981 | Lingmann et al. | 134/2 |
| 4,443,363 | 4/1984 | Klinger et al. | 252/547 |

FOREIGN PATENT DOCUMENTS

| | | |
|---|---|---|
| 3247431 | 6/1984 | Fed. Rep. of Germany . |
| 3321608 | 12/1984 | Fed. Rep. of Germany . |

*Primary Examiner*—A. Lionel Clingman
*Assistant Examiner*—Hoa Van Le
*Attorney, Agent, or Firm*—Henry E. Millson, Jr.; Mark A. Greenfield; Real J. Grandmaison

[57] ABSTRACT

The invention relates to new cationic surfactants based on quaternary ammonium compounds corresponding to the general formula $$R^1\text{-CHOH-CHR}^2\text{-N}^+R^3R^4R^5\,R^6CO_2^- \qquad (1)$$

wherein $R^1$ is a linear or branched alkyl residue having from 1 to 22 carbon atoms;

$R^2$ is hydrogen or a linear or branched alkyl residue having from 1 to 21 carbon atoms, the total number of carbon atoms of the substituents $R^1$ and $R^2$ being in the range of from 8 to 22;

$R^3$ and $R^4$ each represent methyl, ethyl, 2-hydroxyethyl or 2-hydroxypropyl;

$R^5$ represents an alkyl residue having from 4 to 6 carbon atoms or a phenalkyl residue having from 1 to 3 carbon atoms in the alkyl residue; and $R^6$ represents a linear or branched alkyl residue having from 4 to 15 carbon atoms.

The cationic surfactants have particular utility in cleaning agents.

9 Claims, No Drawings

CATIONIC SURFACTANTS BASED ON QUATERNARY AMMONIUM COMPOUNDS AND METHODS OF USING SAME

BACKGROUND OF THE INVENTION

1. Field of the Invention

The present invention relates to cationic surfactants based on quanternary ammonium compounds and their use in cleaning solutions. More specifically, the present invention relates to quaternary ammonium cationic surfactants having corresponding anions with anticorrosive properties.

2. Description of Related Art

Industrial processes for cleaning unfinished and/or finished products, for example automotive parts made of iron or steel, use aqueous solutions containing tensides and other materials such as builders, complexing agents, organic and/or inorganic anticorrosive agents and others. Thus, U.S. Pat. No. 4,284,434 and German Published Appln. No. 32 47 431 propose using quaternary ammonium compounds, in the alkaline pH range, as cationic surfactants together with cleaning components in which alkyl residues of varying chain lengths are bonded to the ammonium nitrogen atom. The corresponding anions of these quaternary ammonium cations are typically chloride, sulfate and methylsulfate anions which are known to promote corrosion, especially the corrosion of equipment parts and the treated metal products themselves. This is extremely disadvantageous, especially in processes treating metal surfaces with aqueous products, and particularly in cases where higher concentrations of cationics are desired. The corrosive tendencies of these solutions cause problems not only during long term storage of the treated parts, but also immediately after they are treated.

U.S. Pat. No. 4,443,363 discloses tenside mixtures used to clean bottles and other articles having hard surfaces (porcelain, synthetics, metal). These mixtures contain cationic tensides based on ammonium compounds. Unfortunately, these tensides also contain corrosive chloride, bromide and/or methylsulfate anions. These anions also tend to corrode the equipment used to apply the surfactant solutions (e.g., dish washers).

German Published Application No. 33 21 608 discloses processes for preparing quaternary ammonium compounds containing at least one long-chain hydroxyalkyl residue. The compounds are prepared by reacting the salt of a tertiary amine and an organic acid in water with a terminal epoxide compound and introducing a hydroxyalkyl residue at standard pressure, at a temperature between 40° C. and 100° C. and at a pH of at least 7. However, the resulting quaternary ammonium compounds, also fail to meet the high requirements set for commercial cationic surfactants with respect to practical serviceability and anticorrosive properties.

Anions of many organic acids are unsuitable as the corresponding anions of cationic surfactants, since the resulting quaternary ammonium compounds have poor solubility in water. These compounds generally have a paste-like consistency and, due to their poor solubility in water, cannot be used in making industrial cleaners. In addition, ammonium cations containing numerous hydroxyalkyl groups cause undesirable precipitations in water which has not been fully de-salted. This renders the use of such cations impractical.

Cationic surfactants are often expected to exhibit de-emulsifying and/or defoaming action on emulsions and/or anionic surfactants or emulsifiers, respectively. However, the quaternary ammonium compounds disclosed in German patent application No. 33 21 608.8 show n de-emulsifying action on emulsions and/or anionic emulsifiers. Furthermore, the lack of de-emulsifying and/or defoaming properties have not been compensated by any improved anticorrosive properties in these surfactants.

DESCRIPTION OF THE INVENTION

Thus, it is an important object of the present invention to provide new and improved cationic surfactants, based on quaternary ammonium compounds, having none of these disadvantages of the prior art surfactants. More specifically, it is an object of the present invention to provide cationic tensides, useful in industrial applications, having anticorrosive properties, which are effective to de-emulsify with respect to anionic contamination, and which can be used in aqueous industrial cleaners; i.e., to provide cationic surfactants that are readily water-soluble, do not cause any undesirable precipitations and which are compatible with the conventional components of industrial cleaners.

These and other objects are attained by providing new improved cationic tensides based on quaternary ammonium compounds. The quaternary ammonium nitrogen atom bears at least two alkyl residues, one hydroxyalkyl residue originating from a terminal epoxide having from 10 to 24 carbon atoms and, optionally, one arylalkyl group. The corresponding anion of the cationic tenside comprises an anion of an organic carboxylic acid having from 5 to 16 carbon atoms. It has surprisingly been found that these cationics not only have good de-emulsifying properties relative to anionic tensides or emulsifiers, respectively, but also render the treated surfaces hydrophobic and thereby lessen the possibility of corrosion by allowing applied liquids to run off smoothly from the treated surfaces and even help to create an antistatic effect on synthetic surfaces.

Accordingly, the present invention provides new improved cationic tensides based on quaternary ammonium compounds corresponding to the following general formula $$R^1\text{-CHOH-CHR}^2\text{-N}^+R^3R^4R^5R^6CO_2^- \qquad (I)$$

wherein

- $R^1$ is a linear or branched alkyl residue having from 1 to 22 carbon atoms;
- $R^2$ is hydrogen or a linear or branched alkyl residue having from 1 to 21 carbon atoms, the total number of carbon atoms of the substituents $R^1$ and $R^2$ being in the range of from 8 to 22;
- $R^3$ and $R^4$ each represent methyl, ethyl, 2-hydroxyethyl or 2-hydroxypropyl;
- $R^5$ represents an alkyl residue having from 4 to 6 carbon atoms or a phenalkyl residue having from 1 to 3 carbon atoms in the alkyl residue; and
- $R^6$ represents a linear or branched alkyl residue having from 4 to 15 carbon atoms.

Examples of the linear or branched alkyl residues represented by $R^1$ and $R^2$ are methyl, ethyl, propyl, isopropyl, n-butyl, tert-butyl, pentyl, hexyl, heptyl, octyl, nonyl, decyl, dodecyl, tetradecyl and hexadecyl. Preferred are those quaternary ammonium compounds wherein $R^2$ is hydrogen and $R^1$ is a linear or branched alkyl residue having from 8 to 22 carbon atoms, e.g., n-octyl, n-decyl, n-dodecyl, n-tetradecyl or n-hexadecyl. In any event, the total number of carbon atoms of the substituents $R^1$ and $R^2$ must be in the range from 8 to 22 carbon atoms.

The residues $R^3$ and $R^4$ each preferably comprise a methyl group.

The residue $R^5$, bonded to the ammonium nitrogen atom, represents an alkyl residue such as, for example, n-butyl, i-butyl, tert-butyl, n-pentyl, tert-butylmethyl, n-hexyl or phenalkyl residues such as benzyl, phenylethyl or phenylpropyl.

The corresponding anion of the cationic surfactants of the present invention is an anion of an organic carboxylic acid having from 5 to 16 carbon atoms. Thus, the residue $R^6$ denotes an alkyl residue, for example, n-butyl, i-butyl, tert-butyl, pentyl, hexyl, octyl, 2-ethylhexyl, n-nonyl, -i-nonyl, decyl, dodecyl or pentadecyl. Preferred residues include the pentyl, hexyl, octyl and 2-ethylhexyl residues. Particularly preferred is the isononanoate anion where $R^6$ is the radical ($C_8H_{17}$-)

In industrial cleaning applications the following cationic surfactants are especially preferred: Benzyldimethyl-2-hydroxydodecylammonium isononanoate (also referred to herein as "BDHAI"), the benzyldimethyl-2-hydroxydodecylammonium salt of 9/13 "Versatic" acid (a saturated highly branched monocarboxylic acid having about 9–13 carbon atoms) sold by Shell Chemical Company in the U.S.A., benzyldimethyl-2-hydroxydodecylammonium isopalmitate, butyldimethyl-2-hydroxydodecylammonium isononanoate and benzyldimethyl-2-hydroxyhexadecylammonium isononanoate. Among these, benzyldimethyl-2-hydroxydodecylammonium isononanoate is particularly preferred.

The compounds corresponding to the general formula I can be prepared according to well known methods of reacting the salt of a tertiary amine having the general formula $$NR^3R^4R^5 \quad \text{(II)}$$

wherein $R^3$, $R^4$ and $R^5$ are as defined above, with an organic acid having the general formula $$R^6CO_2H \quad \text{(III)}$$

wherein $R^6$ is as defined above, in water with an epoxide compound having the general formula

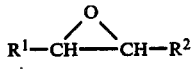

(IV)

wherein $R^1$ and $R^2$ are as defined above and taken together have a total number of carbon atoms in the range from 8 to 22. The tertiary amine salt, the organic acid and the epoxide compound are reacted in stoichiometric ratios at atmospheric pressure and at a temperature between 40° C. and 100° C. The reaction mixture should have a pH of at least 7 before the reaction begins.

The epoxides of general formula IV have from 10 to 24 carbon atoms, and the oxirane ring may have any position on the molecule. However, those quaternary ammonium compounds prepared by reaction of an amine salt with a 1,2-epoxide, i.e., the compounds having the general formula I wherein $R^1$ is an alkyl residue having from 8 to 22 carbon atoms and $R^2$ is a hydrogen atom, are preferred.

The tertiary amines used for the preparation of the quaternary ammonium compounds of the general formula I preferably are tertiary alkyl-, hydroxyalkyl- or alkylarylamines. Dimethylbutylamine and dimethylbenzylamine are particularly preferred.

The carboxylic acids used for the preparation of the quaternary ammonium compounds according to the present invention preferably are monocarboxylic acids having from 5 to 8 carbon atoms in the alkyl moiety. The use of isononanoic acid is particularly preferred.

The quaternary ammonium compounds of the present invention are useful in cationic surfactant industrial cleaning solutions. In such use, the compounds of the present invention have the advantage over known quaternary ammonium cationic compounds having corrosive corresponding anions and which cause undesirable precipitations to occur. In contrast thereto, the corresponding organic acid anions of the ammonium compounds of the present invention do not corrode metal surfaces. Thus, due to the absence of any corrosion promoting anions in the cleaning solutions and further in view of the corrosion inhibiting effect of the carboxylic acid anions, a significant improvement in the anticorrosive properties of aqueous cleaning solutions is accomplished. This is applicable to both products which are stored after cleaning but before further processing, as well as to products which are immediately subjected to further processing. The improved corrosion resistance is especially apparent when cleaning products which, due to their geometrical shape, retain some of the cleaning solution. With conventional cleaners, the danger of corrosion occurring on such solution-retaining shapes was particularly high, since upon vaporization of the solvent, typically water, a high concentration of corrosive components was deposited on the product. These corrosion-prone shapes may now be safely cleaned using the quaternary ammonium cleaning solutions of the invention, without risk of corrosion.

The cationic tensides of the present invention also impart a hyrophobic property to the cleaned surfaces, especially to cleaned metal surfaces. Furthermore, corrosion of the treated articles is further prevented due to the good rinsing property of the cleaning solutions made according to the present invention.

It has further been observed that aqueous cleaning solutions containing the quarternary ammonium cationic surfactants of the present invention, are well suited for cleaning synthetic materials such as plastics since they impart antistatic properties. This is an extremely important property of the compounds of the present invention, since synthetic matrials increasingly tend to be cleaned by spray processes in which static build-up is a serious problem.

The quaternary ammonium surfactants according to the present invention may be used in all types of cleaners used in industrial cleaning operations. Thus, they can be added to sprayable cleaners, e.g., neutral to weakly alkaline cleaners or acidic cleaners, more specifically, cleaning solutions sprayed under high pressure onto the articles to be cleaned. However, they may also be advantageously used in immersion cleaners based on non-ionic surfactants.

The quaternary ammonium cationic tensides of the present invention can also be used as demulsifiers or anti-foaming agents in industrial cleaning solutions, for both spray and immersion cleaning.

The cationic quaternary ammonium surfactants can be used with other known components of known cleaning solutions in accordance with well known procedures. In addition to the quaternary ammonium compounds and other ingredients, said solutions may optionally contain additives such as alkanolamines, phosphates, borates and/or nitrites. If desired, inhibitors, more specially those for nonferrous metals, or biocides such as, for example, hexahydrotriazine derivatives and/or phenols and/or chlorophenols, may be added to the solutions in order to inhibit the growth of bacteria and/or fungi in the spraying or immersing equipment.

The novel compounds of this invention may be incorporated in aqueous and non-aqueous cleaning compositions containing at least one other surfactant and a diluent. The ingredients of the cleaning composition, other than the inventive compounds, are not critical and do not form a part of this invention. The inventive compounds are incorporated in at least an amount effective to: (a) de-emulsify with respect to anionic contamination; (b) impart an anticorrosive effect; (c) impart a defoaming effect; (d) impart hydrophobic properties to a cleaned surface; or (e) impart antistatic properties to a cleaned surface; or any combination thereof.

As used herein, the terms "tenside" and "surfactant" are interchangeable. The term "DIN" means German Industrial Norm.

EXAMPLE 1

(Preparation of benzyldimethyl-2-hydroxydodecylammonium isononanoate) 57.88 g of water were charged into a 500 ml three-necked flask equipped with stirrer, reflux condenser, liquid thermometer and nitrogen cover. In sequence, 67.6 (0.5 moles) od dimethylbenzylamine, 79.12 g (0.5 moles) of isononanoic acid and 94.0 g (0.5 moles) of 1,2-epoxydodecane (epoxide number 8.51) were added thereto. The stirred mixture was heated to 95° C. and maintained under these conditions for 3 hours, after which time the epoxide numer had dropped to a value of less than 0.05. At this time, the acid value and the amine value were determined to be about 2.0 and about 100 respectively. Upon cooling to room temperature, some water was formed which was separated and discarded.

A yield of about 80% benzyldimethyl-2-hydroxydodecylammonium isononanoate (i.e., 290 g) was obtained.

EXAMPLE 2

(Preparation of the benzyldimethyl-2-hydroxydodecylammonium salt of a $C_{9-13}$ saturated synthetic tertiery monocarboxylic acid (9/13 "Versatic" acid)

A three-necked flask equipped with stirrer, temperature control (contact thermometer), reflux condenser and nitrogen cover was charged, in the following sequence, with 59.0 g of water, 67.6 g (0.5 moles) of dimethylbenzylamine, 83.7 g (0.5 moles) of 9/13 "Versatic" acid (acid value 335.3) and 94.0 g (0.5 moles) of 1,2-epoxydodecane (epoxide number 8.51). The mixture was stirred and heated to 95°C. After 2 hours the epoxide number had dropped to 0, and the reaction was complete. After cooling to room temperature, some water formed at the bottom of the flask which was separated and discarded. The resulting dark solution comprised a 20% aqueous solution of the preparation, having an acid value of 4.24 and an Epton value of 95.7 mval/100 g.

EXAMPLE 3

(Preparation of benzyldimethyl-2-hydroxydodecylammonium isopalmitate)

The same apparatus as described in Example 2 was charged, in the following sequence, with 68.1 g of water, 67.6 g (0.5 moles) of dimethylbenzylamine, 130 g (0.5 moles) of isopalmitic acid (acid value 215.3) and 94.0 g (0.5 moles) of 1,2-epoxydodecane. After stirring for 2 hours at 95° C. and subsequent cooling to room temperature, a two-phase system was formed. The aqueous phase was withdrawn, weighed (351.1 g) and discarded. The oil phase contained about 10% of water. The product was a transparent yellow liquid having an epoxide value of 0.0; an acid value of 4.92; and an Epton value of 8.4 mval/100 g.

EXAMPLE 4

(Preparation of n-butyldimethyl-2-hydroxydodecylammonium isononanoate)

In the same apparatus and under the same conditions as described in Example 2, the following materials were reacted; 45.7 g of water, 43.5 g (0.43 moles) of dimethylbutylamine, 68.0 g (0.43 moles) of isononanoic acid (acid value 360.3) and 80.9 g (0.43 moles) of 1,2-epoxydodecane. The work-up procedure for the reaction mixture was the same as described in Example 2. A transparent yellow 80% solution of the product (epoxide value: 0.0; acid value: 3.06; Epton value: 125.1 mval/100 g) was obtained.

EXAMPLE 5

(Preparation of benzyldimethyl-2-hydroxyhexadecylammonium isononanoate)

In the same apparatus and under the same conditions as described in Example 2 the following materials were reacted: 63.2 g of water, 67.6 g (0.5 moles) of dimethylbenzylamine, 79.1 g (0.5 moles) of isononanoic acid (acid value 360.3) and 123.8 g (0.50 moles) of 1,2-epoxyhexadecane (epoxide value 6.46). After cooling to room temperature, 3.1 g of water separated which were withdrawn and discarded. The oil phase was yellow and transparent and contained the product at a concentration of 81%. The product had an epoxide value of 0.06; an acid value of 10.9; and an Epton value of 82.7 mval/100 g.

EXAMPLE 6

Five cleaning solutions, intended for use as spray cleaning solutions having active ingredient concentrations in the range of from 0.5 to 5%, were prepared. The compositions of these solutions were as follows (the percentages are percent by weight):

(a) Neutral Cleaning Solutions (1) and (2):

| | | |
|---|---|---|
| 1. | 30% | of triethanolamine; |
| | 10% | of caprylic acid; |
| | 5% | of a hexahydrotriazine derivative; |
| | 0.5% | of tolyl triazole; |
| | 4% | of an addition product of 2 moles ethylene oxide (EO) and 4 moles propylene oxide (PO) to an alcohol having 18 carbon atoms; |
| | 1% | of an addition product of 5 moles EO and 30 moles PO to 1,2-propylene glycol; |
| | 1.5% | of benzyldimethyl-2-hydroxydodecylammonium isononanoate (INVENTIVE COMPOUND); and |
| | 48.0% | of completely de-salted water. |
| 2. | 10% | of sodium caprylate; |
| | 10% | of triethanolamine; |
| | 5% | of borax; |

-continued

10% of sodium triphosphate;
4% of an addition product of 9 moles EO and 10 moles PO to nonylphenol;
2% of a benzyldimethyl-2-hydroxydodecyl-ammonium salt of 9/13 "Versatic" acid (INVENTIVE COMPOUND); and
59.0% of completely de-salted water.

(b) Alkaline Industrial Cleaning Solution:

15% of potassium triphosphate;
6% of triethanolamine;
5% of potassium hydroxide;
2% of an addition product of 3 moles EO and 6 moles PO to an alcohol having 12 to 18 carbon atoms;
4% of isononanoic acid;
2% of benzyldimethyl-2-hydroxydodecylammonium isopalmitate (INVENTIVE COMPOUND); and
66% of completely de-salted water.

(c) Acidic Cleaning Solutions (1) and (2):

1. 25% of sodium dihydrogenphosphate;
1% of benzoic acid;
0.2% of sodium molybdate;
1% of butyldimethyl-2-hydroxydodecylammonium isononanoate (INVENTIVE COMPOUND);
3% of a modified alcohol ether nonionic tenside ("Triton" DF16) sold by Rohm and Haas Co., Philadelphia); and
69.8% of completely de-salted water.

2. 12% of diethanolamine;
15% of 2-phosphonobutane-1,2,4-tricarboxylic acid;
5% of gluconic acid;
3% of a modified alcohol ether nonionic tenside ("Triton" DF16);
8% of a fatty alcohol sulfate in the form of its sodium salt;
3% of phosphoric acid;
2% of benzyldimethyl-2-hydroxydodecylammonium isonanoate (INVENTIVE COMPOUND); and
52% of completely de-salted water.

The five cleaning solutions formulated as described above were well suited for spraying, having only very little tendency (or in some cases no tendency) towards foaming. The cleaning baths were stable over an extended period of time and maintained their cleaning strength during that period. Due to the use of the quaternary ammonium compounds according to the present invention, the sprayed metal surfaces did not corrode, and had an increased corrosion resistance as compared to similar surfaces treated with conventional cleaners.

EXAMPLE 7

Two alkaline cleaning solutions, intended for use as industrial immersion cleaning solutions having active ingredient concentrations in the range of from 1 to 7%, were prepared.

The composition of these solutions were as follows (the percentages are percent by weight):

1. 15% of potassium triphosphate;
6% of triethanolamine;
6% of isononanoic acid;
1.5% benzyldimethyl-2-hydroxyhexadecylammonium isononanoate (INVENTIVE COMPOUND);
10% of diethanolamine;
5% of an addition product of 10 moles EO to nonylphenol; and
56.5% of completely de-salted water.

2. 40% of sodium diphosphate;
30% of sodium orthophosphate;
10% of sodium triphosphate;
10% of sodium metasilicate;
1% of a benzyldimethyl-2-hydroxydodecylammonium salt of 9/13 "Versatic" acid (INVENTIVE COMPOUND); and -continued 9% of an addition product of 10 moles EO to nonylphenol.

The two alkaline cleaning solutions formulated as described above were highly effective in cleaning treated metal surfaces over an extended period of time. Furthermore, their baths exhibited good stability. Metal surfaces subjected to immersion treatment using the above-described cleaning solutions had increased corrosion resistance as compared to similar surfaces treated with conventional cleaners.

EXAMPLE 8

De-emulsifying Effect

A. Neutral Cleaning Solution:

The de-emuslifying activity of an INVENTIVE COMPOUND (benzyldimethyl-2-hydroxydodecylammonium isononanoate) in a neutral cleaning solution having the following composition (all percentages are percent by weight) is described below:

35% of an alkanolamine $C_8$–$C_{12}$—carboxylate;
2% of 1-hydroxyethane-1,1-diphosphonic acid;
0.5% of mercaptobenzthiazole;
3% of a block polymer of ethylenediamine and 30 moles of ethylene oxide and 60 moles of propylene oxide;
1% of an addition product of 10 moles of ethylene oxide to a $C_{12}$–$C_{16}$ fatty amine; and
58.6% of water.

a. Separation of an Emulsion

The de-emulsification property of a material (i.e., the ability to separate an emulsion into separate and distinct phases) was determined according to the following test:

10 g of drilling oil were emulsified with 40 g of a 2% aqueous neutral cleaning solution in a 270 ml oil-separating flask at room teperature. An equivalent amount of BDHAI was added. The flask was filled, while being shaken, by adding a hot 2% neutral cleaning solution. Separation of the emulsion spontaneously took place. The liquid mixture was maintained at a temperature of 80° C. for 2 hours to affect complete separation of the oil from the "emulsion-like phase", as a first separation, with the result that the oil was substantially quantitatively separated.

b. Addition of an Anti-Foaming Agent 10 g of drilling oil were emulsified with 40 g of a 2% aqueous neutral cleaning solution in a 270 ml oil-separating flask at room temperature. BDHAI was added to this emulsion in an excess over the stoichiometric amount (ratio of de-emulsifier (e.g., BDHAI) to anionic emulsifier was 1.2:1). Also added to this emulsion was an addition product of 30 moles of ethylene oxide and 60 moles of propylene oxide to ethylene diamine, as an anti-foaming agent (ratio of de-emulsifier to anti-foaming agent was 1:1). The flask was filled, while being shaken, by adding a hot 2% neutral cleaning solution. Separation of the emulsion spontaneously took place. The recycled cleaning solution was successfully sprayed without forming a foam.

B. Alkaline Cleaning Solution:

The de-emulsification property of INVENTIVE COMPOUND (benzyldimethyl-2-hydroxydodecylammonium isononanate)alkaline cleaning solutions (a), (b) and (c) having the compositions as set forth herein-below (all percentages are percent by weight) is described below:

| | | |
|---|---|---|
| (a) | 63% | of sodium metasilicate; |
| | 14% | of sodium hydroxide; |
| | 15% | of sodium carbonate |
| | 2% | of an addition product of a fatty alcohol and 14 moles of ethylene oxide; and |
| | 3% | of an alkylbenzenesulfonate. |

A 4% cleaning solution in tap water was emulsified at room temperature with a 2% drilling oil concentrate. Then, more than an equivalent amount (1:1.1) of BDHAI was added, and the mixture was well stirred for about 3 minutes. Then the mixture was allowed to sit. Separation of the oil began immediately.

| | | |
|---|---|---|
| (b) | 60% | of sodium metasilicate; |
| | 10% | of sodium hydroxide; |
| | 15% | of sodium carbonate |
| | 10% | of sodium diphosphate; |
| | 2.5% | of an addition product of a fatty alcohol and 14 moles of ethylene oxide; and |
| | 2.5% | of cocoamine and 12 moles of ethylene oxide. |

A 3% cleaning solution in tap water was emulsified at room temperature with a 2% drilling oil concentrate. Then, double the equivalent amount of BDHAI was added to affect separation of the emulsion. Separation of the oil began immediately, the aqueous phase being nearly clear.

| | | |
|---|---|---|
| (c) | 50% | of sodium diphosphate; |
| | 15% | of sodium triphosphate |
| | 15% | of trisodium phosphate; |
| | 10% | of sodium carbonate |
| | 7.7% | of an addition product of nonylphenol and 14 moles of ethylene oxide; and |
| | 2.3% | of an addition product of coconut fatty acid monoethanolamide and 4 moles ethylene oxide. |

A 2% cleaning solution in tap water was emulsified at room temperature with a 2% drilling oil concentrate. Then, double the equivalent amount of BDHAI was added. Separation of the oil began spontaneously, the aqueous phase being nearly clear.

The presence of pyro- or polyphosphates and/or anionic tensides required the addition of a higher amount of de-emulsifier to affect a complete and rapid de-emulsification.

EXAMPLE 9

Two general cleaning solutions, intended for use in cleaning cars, walls and floors of industrial plants, and products to be steam jet cleaned, having active ingredient concentrations in the range of from 2 to 30%, were prepared. The compositions of these solutions were as follows (The percentages are percent by weight):

| | | |
|---|---|---|
| 1. | 8% | of an addition product of 14 moles EO to an alcohol having 12 to 14 carbon atoms; |
| | 7% | of a fatty alcohol sulfate; |
| | 3% | of butyldimetyly-2-hydroxydodecylammonium isononanoate (INVENTIVE COMPOUND); |
| | 5% | of potassium hydroxide; |
| | 10% | of diethanolamine; |
| | 6% | of phosphoric acid; and |
| | 61% | of completely de-salted water. |
| 2. | 8% | of sodium triphosphate; |

-continued

| | | |
|---|---|---|
| | 5% | of isononanoic acid; |
| | 5% | of boric acid; |
| | 8% | of monoethanolamine; |
| | 1% | of potassium hydroxide; |
| | 5% | of an addition product of 12 moles EO to an amine having 12 carbon atoms; |
| | 3% | of benzyldimethyl-2-hydroxydodecylammonium isopalmitate (INVENTIVE COMPOUND); and |
| | 65% | of completely de-salted water. |

The cleaning solutions having the above-described compositions showed good cleaning ability and at the same time uniform rinsing of the treated surfaces.

The corrosion resistance of metal surfaces and articles, treated with the cleaning solutions containing the quaternary ammonium compounds of the present invention was significantly improved over that of similar metal surfaces and articles treated with conventional cleaners.

EXAMPLE 10

Comparative Corrosion Test

A comparative test of the corrosion-inhibiting properties of two solutions was performed. One of the solutions contained a known quaternary ammonium compound "Dehyquart" LDB sold by Henkel KGA of Dusseldorf; and the other solution contained BDHAI as a quaternary ammonium compound according to the present invention.

The test was carried out in accordance with the chips test of DIN 51360/2 using solutions I and II concentrations of 1%, 2% and 3% in (i) completely de-salted (c.d.) water and (ii) water having a German hardness of 20° d (percentages are percent by weight):

| | |
|---|---|
| Solution I: | |
| 12.5% | of "Dehyquart" LDB (concentration of active ingredient: 35%); |
| 37.5% | of diethanolamine; |
| | remainder water |
| Solution II: | |
| 5.5% | of BDHAI (concentration of active ingredient: 80%); |
| 37.5% | of diethanolamine; |
| | remainder water |

The results are summarized in the following Table.

Degree of Corrosion according to DIN 51360/2

| | Solution I (containing "Dehyquart" LDB) | | Solution II (containing BDHAI) (INVENTIVE COMPOUND) | |
|---|---|---|---|---|
| Concentration of solution | c.d. water | 20° d-water | c.d. water | 20° d-water |
| 1% | 2 | 4 | 0.5 | 3 |
| 2% | 0 | 3 | 0 | 2 |
| 3% | 0 | 2 | 0 | 0.5 |

From respective comparisons of columns 2 against 4 and 3 against 5, Solution II containing BDHAI exhibits a significantly lower degree of corrosion than Solution I containing "Dehyquart" LDB.

We claim:

1. A cleaning composition for metal surfaces comprising at least one surfactant, a diluent, and a quaternary ammonium cationic compound in at least an amount effective to de-emulsify with respect to anionic contamination, impart an anticorrosive effect, impart a defoaming effect, impart hydrophobic properties to a cleaned surface, impart antistatic properties to a cleaned surface, or a combination thereof, said compound having the formula:

$$R^1—CHOCH—CHR^2—N^+R^3R^4R^5\ R^6CO_2^-$$

wherein $R^1$ is a linear or branched alkyl residue having from 1 to 22 carbon atoms;

$R^2$ is hydrogen or a linear or branched alkyl residue having from 1 to 21 carbon atoms, the total number of carbon atoms of both the substitutents $R^1$ and $R^2$ being in the range of from 8 to 22;

$R^3$ and $R^4$ each represent methyl, ethyl, 2-hydroxyethyl or 2-hydroxypropyl;

$R^5$ represents an alkyl residue having from 4 to 6 carbon atoms or a phenalkyl residue having from 1 to 3 carbon atoms in the alkyl residue; and $R^6$ represents a linear or branched alkyl residue having from 4 to 15 carbon atoms.

2. The cleaning composition of claim 1 comprising a spray cleaning solution.

3. The cleaning composition of claim 1 comprising an immersion cleaning solution.

4. The cleaning composition of claim 1 wherein said quaternary ammonium compound comprises benzyldimethyl-2-hydroxydodecylammonium isononanoate.

5. The cleaning composition of claim 1 wherein said quaternary ammonium compound comprises a benzyldimethyl-2-hydroxydodecyclammonium salt of a saturated highly branched monocarboxylic acid having about 9–13 carbon atoms.

6. The cleaning composition of claim 1 wherein said quaternary ammonium compound comprises benzyldimethyl-2-hydroxydodecylammonium isopalmitate.

7. The cleaning composition of claim 1 wherein said quaternary ammonium compound comprises butyldimethyl-2-hydroxydodecylammonium isononanoate.

8. The cleaning composition of claim 1 wherein said quaternary ammonium compound comprises benzyldimethyl-2-hydroxyhexadecylammonium isononanoate.

9. The cleaning composition of claim 1 including alkanolamine, phosphate, borate, and/or nitrite.

* * * * *